United States Patent [19]

Dlott et al.

[11] Patent Number: 4,666,042

[45] Date of Patent: May 19, 1987

[54] TRANSFORMABLE LUNCH-BOX ROBOT

[76] Inventors: Ann Marie Dlott; Stephen P. Dlott, both of 14 Potter Cir., Northboro, Mass. 01532; Anil Saigal, 7-13 Mortimer Pl., Apt. 4, Somerville, Mass. 02145

[21] Appl. No.: 826,684

[22] Filed: Feb. 6, 1986

[51] Int. Cl.[4] ..... B65D 81/36

[52] U.S. Cl. ..... 206/542; 206/315.1; 206/457; 206/579; 273/239; 446/73

[58] Field of Search ..... 206/216, 315.1, 457, 206/541, 542, 546, 579; 273/239; 446/71-81, 97-99

[56] References Cited

U.S. PATENT DOCUMENTS

| | | | |
|---|---|---|---|
| 888,554 | 5/1908 | Tuttle | 206/546 |
| 2,748,527 | 6/1956 | Seals | 446/71 |
| 3,791,550 | 2/1974 | Duncan | 206/457 |
| 3,851,885 | 12/1974 | Pepkowski et al. | 273/239 |
| 4,101,131 | 7/1978 | Barnby | 273/239 |
| 4,209,085 | 6/1980 | Kozan | 206/315.1 |
| 4,285,157 | 8/1981 | Lambert | 446/76 |
| 4,326,356 | 4/1982 | Mason | 446/73 |
| 4,581,904 | 4/1986 | Lehmann et al. | 446/99 |
| 4,593,817 | 6/1986 | Ferrero | 206/457 |

*Primary Examiner*—William Price
*Assistant Examiner*—Jimmy G. Foster
*Attorney, Agent, or Firm*—Samuels, Gauthier, Stevens & Kehoe

[57] ABSTRACT

A child's lunch box designed so as to be readily transformable into a toy robot is disclosed. A specially designed cover portion covers one panel of the lunch box and defines a normally concealed compartment containing attached arm members and a head member. To transform the lunch box into a toy robot, the special compartment is opened and the arm and head members contained therein are extended. The process is reversed to transform the toy robot back to a lunch box.

12 Claims, 7 Drawing Figures

TRANSFORMABLE LUNCH-BOX ROBOT

BACKGROUND OF THE INVENTION

A currently popular trend in children's toys are the so-called "transformers"-toys which can be readily converted into other toys by making minor modifications in the structure of the toys. For example, toy cars are available which can be transformed into toy guns, and toy robots which can be transformed into trucks, and back again.

At the same time, among trend-conscious children, who have always been strongly influenced by the ins and outs of style as dictated by their peers, the lowly, traditional lunch box has fallen out of favor. While remaining practical and handy as a means for children to carry their lunches and other snacks to school, the ordinary, unadorned lunch box has little appeal to the younger generation. In effort to increase the appeal of the traditional lunch box, manufacturers have taken to adorning the outsides of their lunch boxes with names, faces and scenes from popular television series, movies, popular singers, cartoons and the like.

The present invention is designed both to increase the appeal of the lunch box to children as well as to capitalize on the transformable trend in toys. The novel design of this invention makes it possible to have a full-size and fully useable lunch box which can also be readily transformed into a toy robot, and back again into a lunch box.

The prior art discloses numerous types of lunch box designs, some of which also have utility as toys. For example, U.S. Design Pat. Nos. 251,284 and 253,330 shows lunch boxes in the designs of footballs. U.S. Design Pat. No. 255,084 shows a lunch box in the design of a sandwich; and, U.S. Design Pat. No. 260,595 shows a lunch box in the design of a house. U.S. Pat. No. 4,216,862 shows a lunch box design in which the cover defines two inner compartments in such a way that the open lunch box doubles as a serving tray. None of the prior art shows a lunch box design which permits conversion into a toy robot.

Similarly, the prior art discloses numerous types of toy robot designs, some of which can be folded up for carrying or storing or else can be transformed into other toys. For example, U.S. Pat. Nos. 4,456,384 and 4,411,097 show toy robots capable of being folded up so as to fit into or form a more or less rectangular space. None of the prior art, however, shows a toy robot which can be transformed into or made from a lunch box.

DESCRIPTION OF THE PREFERRED EMBODIMENT

Figure 1:
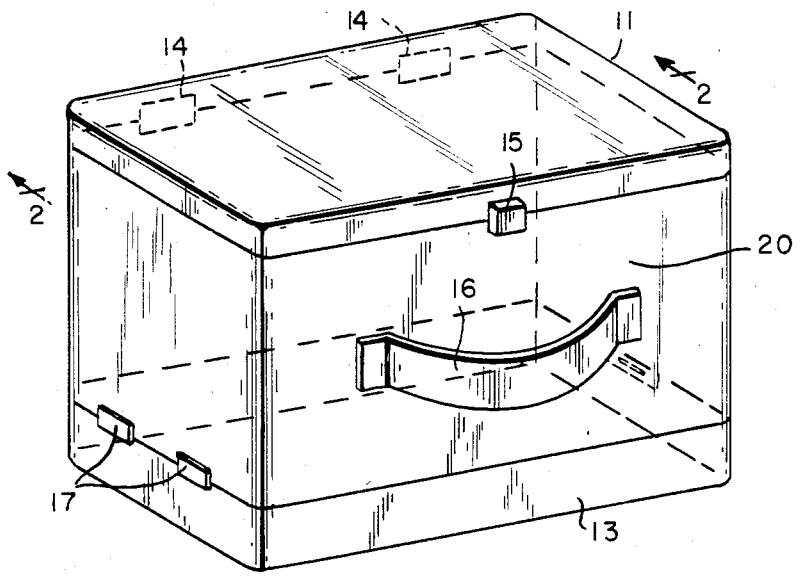
FIG. 1 is a perspective view of the lunch box-robot of this invention in the fully closed position.

As shown in FIG. 1, the lunch box of this invention, from the outside at least, resembles an ordinary children's lunch box. It consists of a conventional metal or plastic container with a top cover 11 attached to the container by means of top hinges 14 and also having a strap or carrying handle 16. Cover 11, which can also be made of metal or plastic, is kept in place by any suitable latch or retaining means such as clasp lock 15 which is engaged in FIG. 1 to keep the lunch box shut. By unclasping lock 15 and opening cover 11, access is had to the main interior compartment 20 of the lunch box.

A second cover 13, which can also be made from metal or plastic, is designed to cover the entire exterior of bottom wall of the lunch box, thereby forming a second interior compartment. Cover 13 is attached to the container by means of side hinges 17, and is used to transform the lunch box into the toy robot as hereinafter described. Cover 13 is secured in place by means of a mating latch and slot mechanism as subsequently described.

Figure 2:
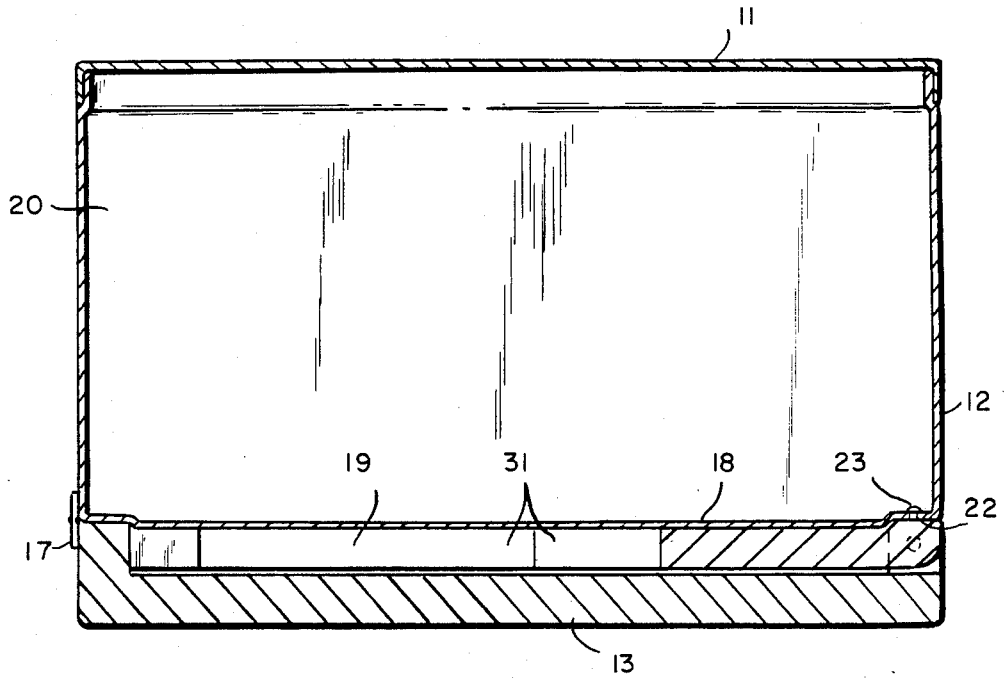
FIG. 2 is a sectional view of the lunch box along the line 2—2 in FIG. 1.

FIG. 2 is a sectional view of the lunch box along the line 2—2 in FIG. 1. This view more clearly shows the main interior compartment 20 defined by the sides of the lunch box 12 and top cover 11 as well as the secondary interior compartment 19 defined by bottom wall 18 and cover 13. Located within compartment 19 can be seen robot arm members 31. Cover 13 is secured in place by latch 22 designed to engage and mate with slot 23 as shown in FIG. 2. When latch 22 is released, cover 13 can open on hinges 17. By thus releasing cover 13 and rotating it upward on hinges 17, the apparent size of the container is doubled and the arm and head members of the robot, otherwise concealed in compartment 19, are exposed.

Figure 3:
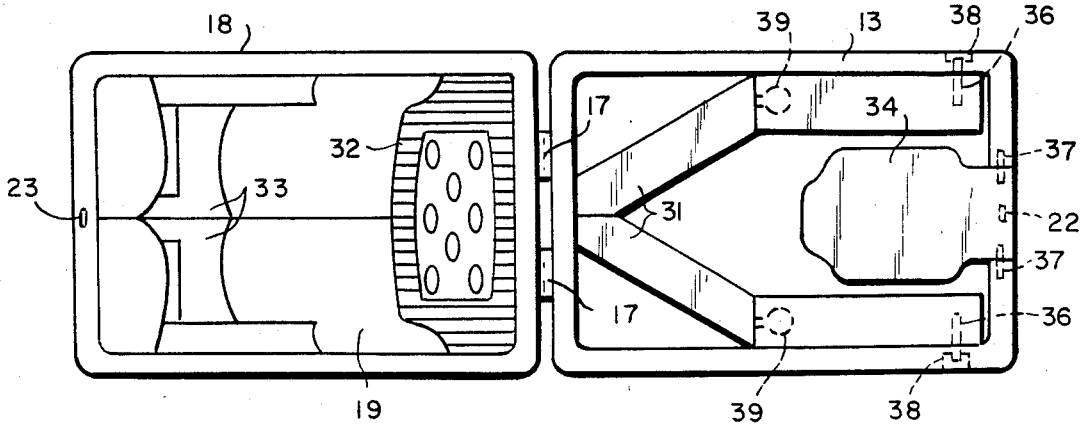
FIG. 3 is a front view of the lunch box with the upper cover lifted to show the arm and head members of the robot, in their folded positions.

FIG. 3 is a front view with cover 13 open thereby exposing the interior of compartment 19 and the parts of the robot. The bottom half of the robot is inscribed on the exterior face of bottom panel 18 which had previously been concealed by cover 13. The lower body 32 and legs 33 of the robot are defined by contrasting colors on the face of bottom panel 18. The top half of the robot is developed from within compartment 19. The arm members 31, the head member 34, and a vest portion (not shown) of the robot are housed inside compartment 19. The head member 34 is hinged to cover 13 with hinge 37 and can be raised up and locked into place with any suitable mechanism, for example a slot (not shown) designed to mate with latch 22. The arm members 31, normally folded inside compartment 19, can be unfolded and extended from each side of cover 13. Once they are unfolded, the arms can be moved around the arm articulation pins 36 and their respective axes 38. The arms 31 consist of upper arm and forearm members connected by elbow joints 39. The articulation pins 36 and elbow joints 39 have frictional restraints so that the arms 31 can be adjusted to and maintained in any desired positions.

To reconvert the robot back to a lunch box, arms 31 are folded back into compartment 19, head 34 is folded back into compartment 19, and cover 13 is closed over bottom panel 18. Cover 13 is secured in place over bottom panel 18 by means of inserting latch 22 into slot 23.

Figure 4:
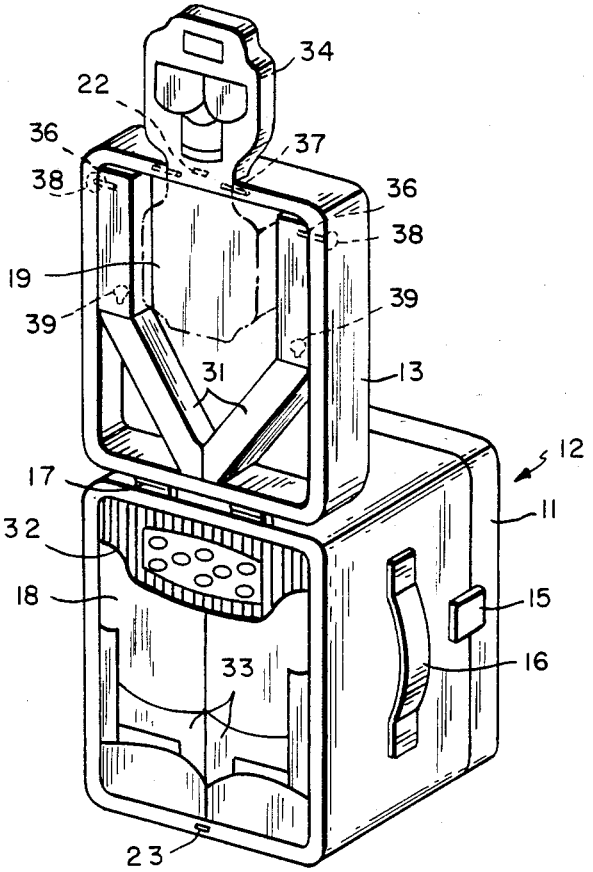
FIG. 4 is a perspective view of the open lunch box with the head member of the robot fully extended.

FIG. 4 is a perspective view of the robot in a partially opened position. In FIG. 4, the head 34 is raised but the arms 31 are still folded into compartment 19. The head is shown hinged to cover 13 with hinge 37, and locked in the upright position by being snapped into place using latch 22.

Figure 5:
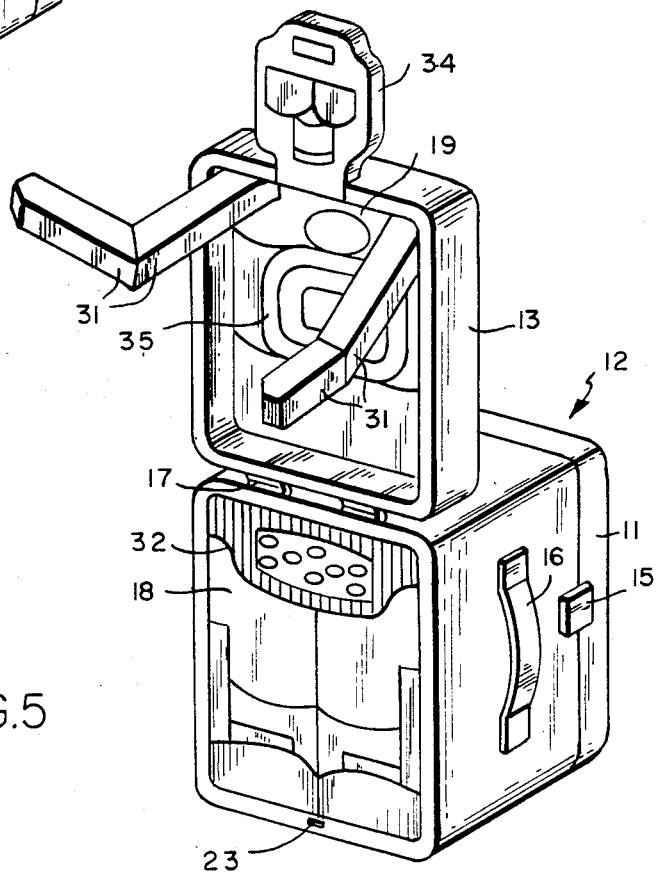
FIG. 5 is a perspective view of the open lunch box with both the arm and the head members of the robot fully extended.

FIG. 5 is a perspective view of the robot in a fully opened position. In FIG. 5, the arms 31 are unfolded and extended revealing the vest portion 35 of the robot. The vest 35 is inscribed on the inner face of cover 13 in one or more contrasting colors. Arms 31 can rotate from the shoulders by means of the arm articulation pins and axes, as previously described; and, they can rotate from the elbows by means of the elbow joints, also as previously described.

By reversing the process described above, the head 34 and arms 31 of the robot can be folded back into compartment 19 and cover 13 can be closed and latched thereby transforming the robot back into a lunch box.

Many other variations and modifications of my basic design will be readily apparent to those skilled in the art, and all such variations and modifications are intended to be encompassed by this application. For example, in place of the toy robot of this invention, one could readily substitute a human form or animal form. In place of the head and arms of the robot, other human or animal limbs could be substituted. In place of the toy robot, the lunch box of this invention could also be converted to a magnetic game board suitable for playing checkers, chess and the like wherein said game board would be concealed within compartment 19.

Figure 6:
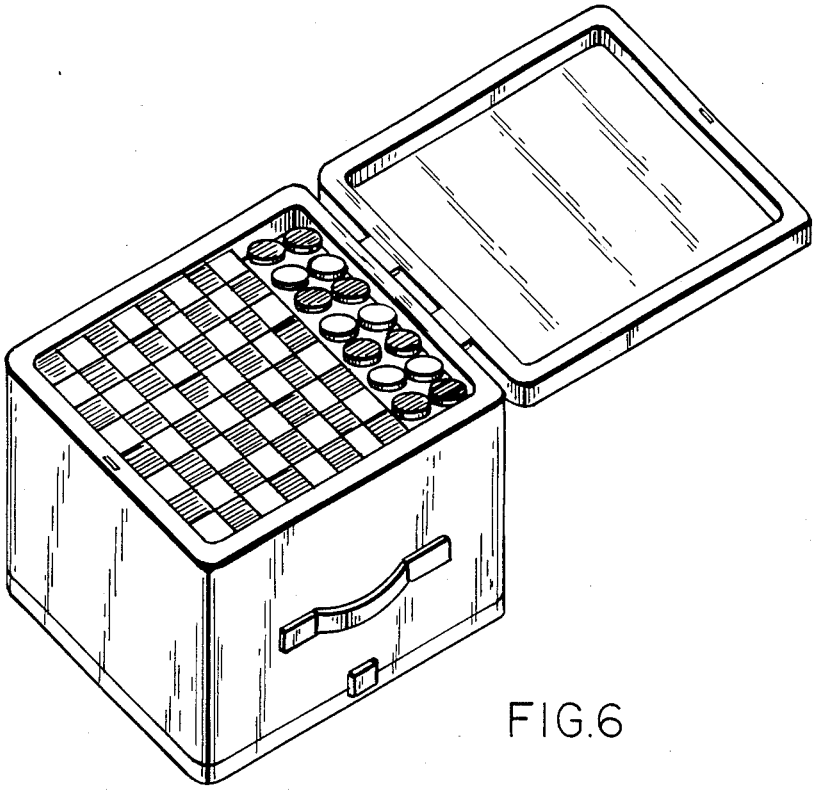
FIG. 6 is a schematic perspective view of the open lunch box illustrating the embodiment whereby the invention is a combination lunch box-magnetic game board.
Figure 7:
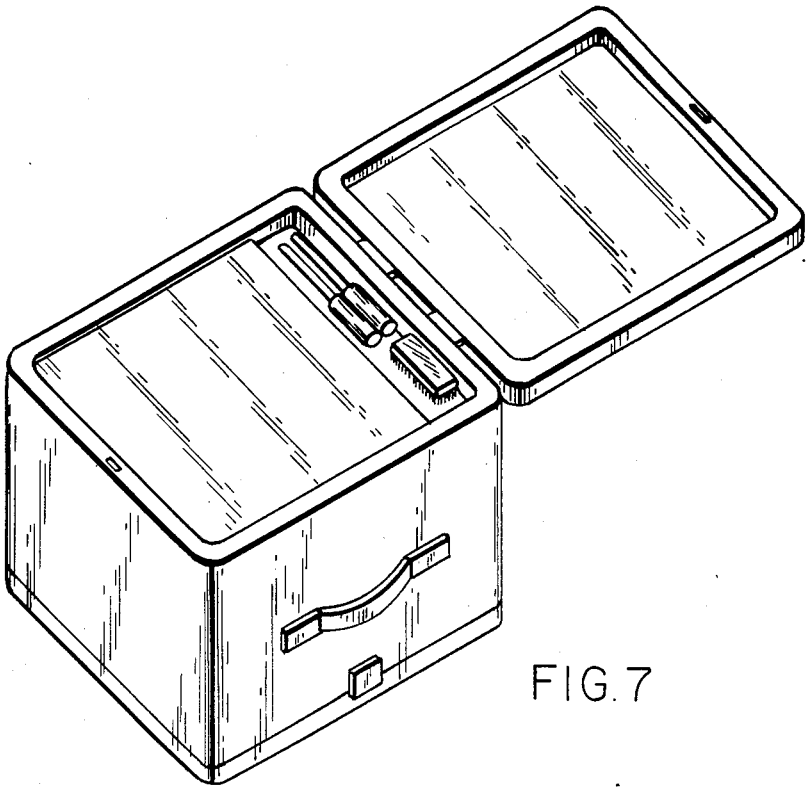
FIG. 7 is a schematic perspective view of the open lunch box illustrating the embodiment wherein the invention is a combination lunch box-erasable plastic drawing game board.

The embodiments wherein the lunch box of this invention can be converted to a game board are illustrated in FIGS. 6 and 7. FIG. 6 shows a magnetic game board for playing checkers. FIG. 7 shows an erasable plastic drawing game board for drawing or writing.

Having described our invention, what we claim is:

1. An article of manufacture useful interchangeably as a lunch box or a toy comprisng the following:

(a) a substantially rectangular container having five walls, each consisting of an interior side and an exterior side, thereby defining a primary interior compartment having one open side;

(b) first openable cover means covering said one open side by which said container can be opened to access said primary interior compartment;

(c) second openable cover means by which a secondary interior compartment is created between said second cover means and the exterior side of one wall of said container;

(d) retaining means to secure said first and second cover means in place; and, (e) means located inside and fully enclosed by said secondary interior compartment for converting said article into a toy.

2. The article of claim 1 wherein said means located inside and fully enclosed by said secondary interior compartment comprise a game board.

3. An article of manufacture useful interchangeably as a lunch box or a toy comprising the following:

(a) a substantially rectangular container having five walls, each consisting of an interior side and an exterior side, thereby defining a primary interior compartment having one open side;

(b) first cover means covering said one open side by which said container can be opened to access said primary interior compartment;

(c) second cover means by which a secondary interior compartment is created between said second cover means and the exterior side of one wall of said container;

(d) retaining means to secure said first and second cover means in place; and, (e) means located inside and fully enclosed by said secondary interior compartment for converting said article into a toy wherein said means located inside said secondary interior compartment comprise movable members capable of being extended outwardly from said secondary interior compartment when said second cover means is open so as to resemble at least one limb of a human, animal, or robot-like figure.

4. The article of claim 3 additionally including hinge means by which said first and second cover means are opened and closed.

5. The article of claim 3 wherein said exterior side of one wall of said container has inscribed thereon a drawing which resembles a lower body portion of a human, animal or robot-like figure.

6. The article of claim 5, wherein said drawing comprises a lower body and legs of a robot and wherein said movable members comprise a head and arms of a robot.

7. The article of claim 6 wherein said movable head members are hinged to said second cover means, and said arm members are connected to said second cover means.

8. The article of claim 7 additionally wherein said arm members include elbow joints connecting upper arm and forearm members such that the forearm members can swivel about said elbow joints.

9. The article of claim 7 wherein said movable head member is maintained in an upright position by means of a slot which mates with latch means on said second cover means.

10. The article of claim 3 including handle means for carrying said article.

11. The article of claim 3, wherein said retaining means for securing said second cover means comprises a latch on said second cover means which mates with a slot along one edge of said one wall of said container.

12. The article of claim 3 wherein said article is fabricated from metal, plastic or a combination thereof.

* * * * *